US007025494B2

(12) United States Patent
Oomori et al.

(10) Patent No.: US 7,025,494 B2
(45) Date of Patent: Apr. 11, 2006

(54) WRIST-PORTABLE APPARATUS

(75) Inventors: Nobukazu Oomori, Chiba (JP); Haruki Hiranuma, Chiba (JP)

(73) Assignee: Seiko Instruments Inc., Chiba (JP)

( * ) Notice: Subject to any disclaimer, the term of this patent is extended or adjusted under 35 U.S.C. 154(b) by 609 days.

(21) Appl. No.: 10/124,352

(22) Filed: Apr. 16, 2002

(65) Prior Publication Data

US 2002/0167866 A1 Nov. 14, 2002

(30) Foreign Application Priority Data

Apr. 27, 2001 (JP) ..... 2001-132737

(51) Int. Cl.
*G04B 27/02* (2006.01)
*G04B 29/00* (2006.01)
*G04B 37/00* (2006.01)

(52) U.S. Cl. ..... 368/190; 368/308; 368/319

(58) Field of Classification Search ..... 368/10, 368/11, 15, 20, 21, 27, 35, 37, 76, 77, 223, 368/233, 190, 319–320, 69, 191, 308

See application file for complete search history.

(56) References Cited

U.S. PATENT DOCUMENTS

| | | | | | |
|---|---|---|---|---|---|
| 2,456,122 | A | * | 12/1948 | Guilden | 368/27 |
| 3,318,085 | A | * | 5/1967 | Lee | 368/27 |
| 3,675,411 | A | * | 7/1972 | Sakuma | 368/27 |
| 4,731,767 | A | * | 3/1988 | Uehara | 368/15 |
| 5,253,225 | A | * | 10/1993 | Vaucher | 368/20 |
| 5,383,166 | A | * | 1/1995 | Gallay | 368/288 |

* cited by examiner

*Primary Examiner*—Vit W. Miska
(74) *Attorney, Agent, or Firm*—Adams & Wilks

(57) ABSTRACT

A wrist-portable apparatus has a case housing a rotational display member and an operational shaft for undergoing rotational movement and sliding movement relative to the case so that the operational shaft may be axially displaced between a pushed-in position, in which the operational shaft is pushed into the case, and a drawn-out position, in which the operational shaft is drawn out from the case. A clutch assembly transmits rotational movement of the operational shaft to the display member to rotate the display member when the operational shaft is displaced to the drawn-out position and releases the transmission of the rotational movement of the operational shaft to the display member when the operational shaft is displaced to the pushed-in position. A manual control stem is integrally connected to an end of the operational shaft and is disposed on a side surface portion of the case for controlling rotation of the operational shaft and displacement of the operational shaft to the pushed-in and drawn-out positions.

12 Claims, 7 Drawing Sheets

WRIST-PORTABLE APPARATUS

BACKGROUND OF THE INVENTION

1. Field of the Invention

The present invention relates to a wrist-portable equipment, and more particularly to a wrist-portable apparatus provided with a display member rotating independently and separately from a gear train of circumferential divisional hour/minute/second.

2. Description of the Prior Art

In a wrist-portable equipment, a technology for rotating and operating a display member provided in an interior of a case member by a stem provided in the outside of the case member is currently known. FIG. 8 is a plan view showing a body of a conventional wristwatch 100. FIG. 9 is a side elevational cross-sectional view showing a primary part of the wristwatch 100 described in FIG. 9. In FIGS. 8 and 9, the wristwatch 100 has a letter plate 102 and a scale ring 103 within a watch case 101.

Also, a stem 104 for rotating the scale ring 103 is mounted independently and separately from a stem 105 for correcting hour/minute/second hands, on the side surface portion of the watch case 101. This stem 104 is made of a metal member and has a cup-like shape. A cup bottom portion of this stem 104 is formed integrally so as to cover one end portion of a cylindrical operating shaft 106 made of a metal member. The operating shaft is inserted into the watch case 101 by passing through a pipe 107 which is securely provided to and penetrates through the watch case.

A gear 109 made of plastic or metal material is fitted into the vicinity of a tip end portion 108 of the inserted operating shaft 106. This gear 109 is fixed to the operating shaft 106 by means of a ring-shaped fastening member 110 made of metal material. On the other hand, the above-described scale ring 103 is disposed with its display portion 111 facing the side of a watch glass 112, its bottom portion 113 facing the side of the letter plate 102 and its side portion 114 facing the inner wall of the watch case 101. The scale ring 103 has a rack 116 on a circumferential portion of its back surface. The scale ring 103 is engaged with the above-described gear 109 in this rack 116.

In this wristwatch 100, when the scale ring 103 is to be adjusted, the stem 104 is pinched by the fingers to rotate it in the axial direction by the fingers. Then, the operating shaft 106 formed integrally with the stem 104 is also rotated and the gear 109 fixed at its tip end portion 108 is also rotated. When the gear 109 is rotated, the rack 116 of the scale ring 103 engaging therewith is fed so that the scale ring 103 is also rotated. Thus, it is possible to adjust the scale ring 103 in a desired position by controlling the stem 104 while watching the scale ring through the glass 112 of the watch.

Thus, in the conventional wristwatch 100, the scale ring 103 and the stem 104 mounted on the side surface portion of the watch case 101 are always coupled with each other through the operating shaft 106 and the gear 109. For this reason, there are cases where, when it is mounted on the wrist, the stem 104 is rotated due to its contact with the body, wear cloth or the like and the scale ring 103 is displaced as a result. For this reason, in the conventional wristwatch 100, a ring-shaped frictional member 117 made of elastic system material is provided on the inner wall surface of the stem 104 to thereby generate friction with the pipe 107 to suppress such an unnecessary rotation and to prevent malfunction of the scale ring 103. Note that, the member 118 provided on the bottom surface portion 113 of the scale ring 103 is an annular cushion 118 made of elastic system material for preventing the displacement of the scale ring 103 during the rotation. The member 119 provided in the intermediate portion of the operating shaft 106 is an annular water-proof packing 119 made of elastic system material for sealing a gap between the operating shaft 106 and the pipe 107.

However, the malfunction of the above-described scale ring 103 could not be completely prevented by the provision of the cushion 117 as described above. Also, it is necessary to consider frequent and vigorous contact which may take place between the stem 104 and the body or the like in the case where the wristportable equipment is worn while playing a sport or the like. On the other hand, unduly increasing the fastening degree of the above-described cushion 117 in order to prevent the above-described malfunction leads to the necessity of excessive force for rotating the stem 104 for performing adjustment of the scale ring 103. Thus, there is a certain limitation regarding this approach.

SUMMARY OF THE INVENTION

Accordingly, in view of the above, an object of the present invention is to provide a wrist-portable apparatus or equipment that may effectively prevent the malfunction of a display member.

In order to attain the above-described object, the portable equipment according to this invention is characterized by comprising a case, an internal rotational ring that rotates independently and separately from a gear train of circumferential divisional hour/minute/second within the above-described case, and is used as a display member; an operating shaft that may be pushed in and drawn out from the above-described case; a clutch for transmitting the rotation of the above-described operating shaft to the above-described internal rotational ring and for releasing the transmission of the rotation by pushing in the above-described operating shaft; and a stem provided at one end portion of the above-described operating shaft and disposed on a side surface portion of the above-described case.

According to this invention, when the internal rotational ring is to be rotated, the stem is pinched and drawn out from the case by the fingers. Then, the operating shaft fixed to the stem is also shifted in a direction in which the stem is drawn out and the clutch works for effecting connection between the operating shaft and the internal rotational ring. Under this condition, when the stem is rotated, the operating shaft is also rotated and the rotation of the operating shaft is transmitted to the internal rotational ring by means of the clutch. Thus, it is possible to adjust the internal rotational ring while rotating the stem. Also, when the internal rotational ring is to be locked, the stem is pushed into the case. Then, the clutch is released by the opposite operation to the above-described draw operation so that the above-described operating shaft is separated from the internal rotational ring. Under this condition, even if the stem is accidentally rotated due to some reason, since the stem and the internal rotational ring are separated by means of the clutch so that the rotation of the stem is not transmitted to the internal rotational ring. Note that, the display member means a member for displaying letters or figures and includes a letter plate, a scale ring or the like.

Also, the wrist-portable equipment according to this invention, is characterized by comprising, in the above-described wrist-portable equipment, a first rotation transmission member fixed by inserting the above-described operating shaft therethrough and a second rotation transmission member provided in the above-described internal rotational ring and to which the rotation from the above-described first rotation transmission member is transmitted, wherein the rotational transmission between these first rotation transmission member and the second rotation transmission member is released by pushing in the above-described operating shaft.

In this invention, under the lock condition of the internal rotational ring, the first rotation transmission member and the second rotation transmission member are separated from each other. When this lock is to be released to rotate the internal rotational ring, the stem is pinched and the stem is drawn out of the case by the fingers. Then, the operating shaft provided on the stem is shifted in the direction in which the stem is drawn out together with the first rotation transmission member, and the first rotation transmission member is engaged or brought into frictional contact with the second rotational transmission member formed in the outer circumferential portion of the internal rotational ring. Under this condition, when the stem is rotated by the fingers, the rotating shaft is also rotated and then the first rotation transmission member is also rotated. Then, the second rotation transmission member engaging with this is also rotated and the internal rotational ring is rotated. Thus, the internal rotational ring may be adjusted by rotating the stem.

Furthermore, when the internal rotational ring is to be locked, the stem that has been drawn out is pushed into the case. Then, the operating shaft is shifted in the direction in which the stem is drawn out and the rotational transmission between the first rotation transmission member and the second rotation transmission member is released. Thus, the clutch is separated and malfunction of the internal rotational ring is prevented. Note that, it is preferable that the combination of the first rotation transmission member and the second rotation transmission member for constituting the clutch be a combination by which the effective rotation transmission is possible, such as a gear and a rack, a conical frictional member and a friction member or any other such combination. Note that, the transmission of rotation as described herein may include not only the case where direct transmission is established between the first rotation transmission member and the second rotation transmission member but also the case where an intermediate transmission member such as an intermediate gear or the like is used in its intermediate path.

Also, the wrist-portable equipment according to this invention is characterized in that the above-described clutch comprises: a bulged portion having a polygonal cross-section and formed in the above-described operating shaft and an intermediate wheel having a through hole for allowing the above-described operating shaft to pass therethrough, engaging on at least one surface with the above-described bulged portion in an inner circumferential surface of the above-described through hole and engaging with the above-described internal rotational ring in its outer circumferential surface, wherein the engagement between the above-described bulged portion and the above-described intermediate wheel is released by pushing in the above-described operating shaft.

In this invention, under the lock condition of the internal rotational ring, the bulged portion of the above-described operating shaft and the intermediate wheel are separated from each other. When this lock is to be released to rotate the internal rotational ring, the stem is pinched and the stem is drawn out of the case by the fingers. Then, the operating shaft fixed to the stem is also shifted in the direction in which the stem is drawn out and accordingly the bulged portion formed on the operating shaft is also shifted. Here, the bulged portion that has the above-described polygonal shape is engaged with the inner surface of the through hole provided to the intermediate wheel while rotating the stem. Under this condition, when the stem is rotated by the fingers, the rotating shaft is also rotated and the bulged portion is also rotated accordingly. Then, the intermediate wheel engaging with this is also rotated by the external force from the engagement surface and the internal rotational ring is also rotated. Thus, the internal rotational ring may be adjusted by rotating the stem. Furthermore, when the internal rotational ring is to be locked, the stem that has been drawn out is pushed into the case. Then, the operating shaft is shifted in the direction in which the stem is drawn out and the engagement between the bulged portion of the operating shaft and the inner circumferential surface of the intermediate wheel is released. Thus, the clutch is separated and the malfunction of the internal rotational ring is prevented.

Note that, the above-described invention includes the case where the bulged portion has a conical shape, a truncated conical shape and any other polygonal shape and the engagement surface with the above-described intermediate wheel is disposed on the side where the above-described operating shaft is drawn out. In this case, when the internal rotational ring is to be released, the bulged portion of the above-described operating shaft is shifted in the direction in which the stem is drawn out by drawing out the stem. Then, the engagement portion between the bulged portion of the operating shaft and the intermediate wheel is sought by rotating the stem and these are engaged with each other. In this case, since the engagement surface with the intermediate wheel faces the side where the operating shaft is drawn, by the draw force of the above-described stem, the bulged portion is biased to the intermediate wheel by the force applied for drawing the above-described stem. Furthermore, when the operating shaft is shifted in the pushing-in direction by pushing in the stem, the bulged portion of the operating shaft is separated from the inner circumferential surface of the intermediate wheel by pushing in the stem.

Also, the wrist-portable equipment according to this invention is characterized in that the above-described clutch comprises: a bulged portion formed in the above-described operating shaft and made of a frictional material; and an intermediate wheel having a through hole for allowing the above-described operating shaft to pass therethrough and engaging with the above-described bulged portion in an inner circumferential surface of the above-described through hole, and engaging with the above-described internal rotational ring in its outer circumferential surface, wherein the engagement between the above-described bulged portion and the above-described intermediate wheel is released by pushing in the above-described operating shaft.

In this invention, under the lock condition of the internal rotational ring, the bulged portion of the above-described operating shaft and the intermediate wheel are separated from each other. When this lock is to be released to rotate the internal rotational ring, the stem is pinched and the stem is drawn out of the case by the fingers. Then, the operating shaft fixed to the stem is shifted in the direction in which the stem is drawn out together with the bulged portion. Under this condition, when the stem is rotated by the fingers, the rotating shaft is also rotated and the bulged portion is also rotated. Then, the intermediate wheel engaging with this is also rotated by the frictional force with the above-described bulged portion, and thus the internal rotational ring is also rotated. Thus, the internal rotational ring may be adjusted by rotating the stem. Furthermore, when the internal rotational ring is to be locked, the stem that has been drawn out is pushed into the case. Then, the operating shaft is also shifted in the direction in which the stem is drawn out and the engagement between the bulged portion of the operating shaft and the inner circumferential surface of the intermediate wheel is released. Thus, the clutch is separated and the malfunction of the internal rotational ring is prevented.

Note that, the above-described invention includes the case where the bulged portion has a conical shape, a truncated conical shape, a spherical shape and any other curved shape and the engagement surface with the above-described intermediate wheel is disposed on the side where the above-described operating shaft is drawn out. In this case, when the internal rotational ring is to be released, the bulged portion of the above-described operating shaft is shifted in the direction in which the stem is drawn out by the draw operation of the stem. In this case, since the engagement surface with the intermediate wheel faces the side at which the operating shaft is drawn out, the bulged portion is biased toward the intermediate wheel due to the force applied for drawing the above-described stem. Furthermore, when the operating shaft is shifted in the pushing-in direction by pushing in the stem, the bulged portion of the operating shaft is separated from the inner circumferential surface of the intermediate wheel by the push-in operation of the stem.

Also, the wrist-portable watch of this invention is characterized by further comprising a fastening means for fastening the above-described stem to the above-described case when the above-described operating shaft is being pushed in.

In this invention, when pushing in the above-described shaft, the stem may be fixed to the case by the above-described fastening means. Accordingly, since drawing out of the stem may be further restricted in the state where the above-described clutch is being separated, it is possible to completely prevent malfunction of the internal rotational ring.

Also, the wrist-portable equipment according to this invention is characterized by further comprising a cushion made of elastic system material disposed on the side surface of the internal rotational ring and being biased toward the inner wall of the case. According to this invention, the cushion provided on the side surface of the internal rotational ring is biased to the inner wall of the case to thereby prevent any rattling upon the rotation of the internal rotational ring.

BRIEF DESCRIPTION OF THE DRAWINGS

A preferred form of the present invention is illustrated in the accompanying drawings in which:

FIGS. 4 4A–4B are a plan view and a side elevational cross-sectional view, respectively, showing an intermediate wheel;

DETAILED DESCRIPTION OF THE PREFERRED EMBODIMENTS

The present invention will now be described in detail with reference to the accompanying drawings. It is understood that the present invention is not limited to the embodiments described. The structural elements of the embodiments described below may include those to which design alterations may typically be performed by the person skilled in the art.

Figure 1:
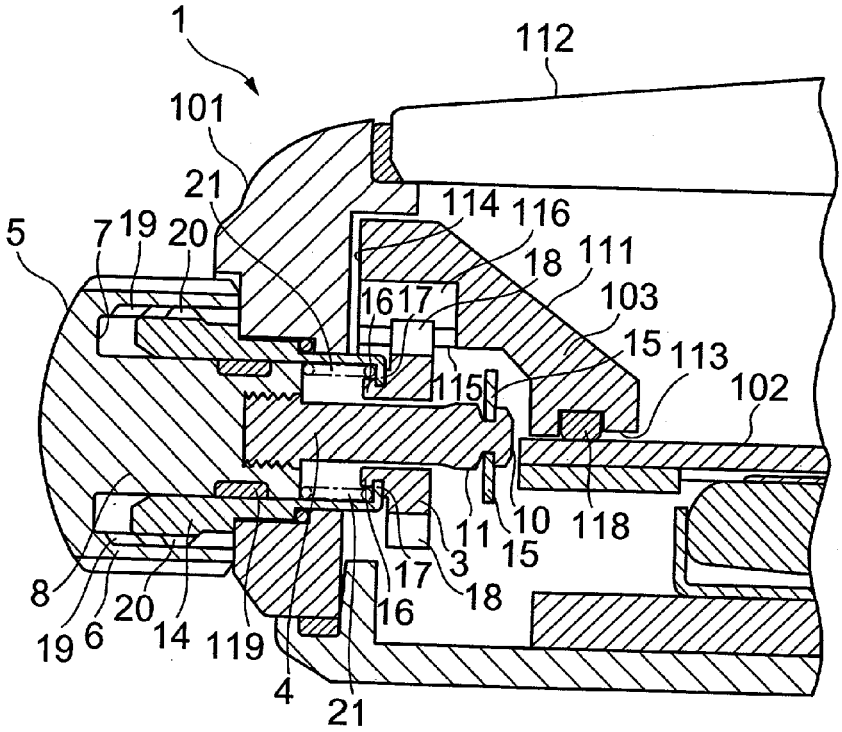
FIG. 1 is a cross-sectional view showing a wrist-portable equipment that is a mode of embodiment of this invention.
Figure 2:
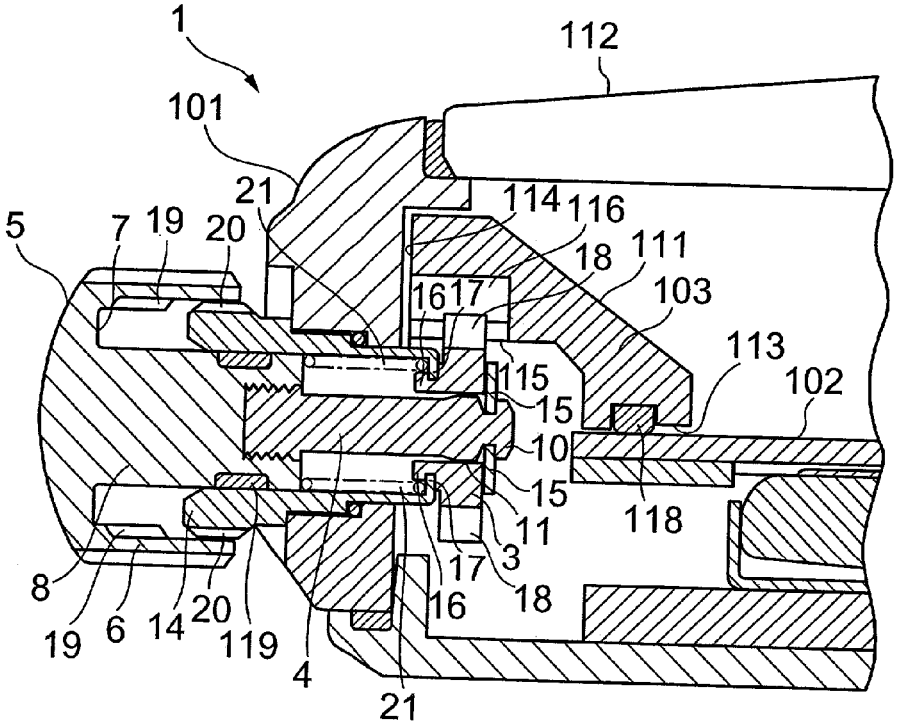
FIG. 2 is a cross-sectional view showing the wrist-portable equipment that is the mode of embodiment of this invention.
Figure 3:
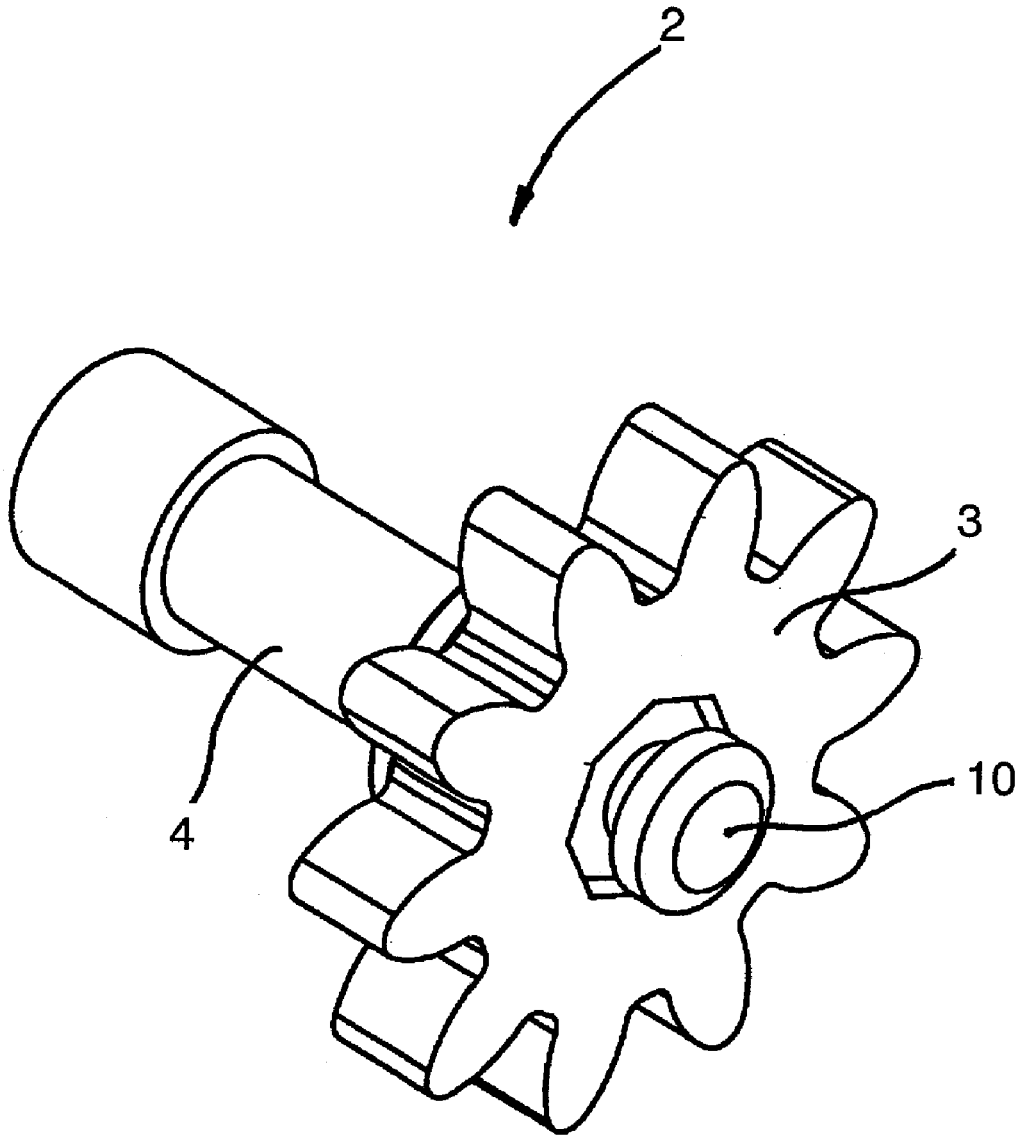
FIG. 3 is a perspective view showing a clutch portion of the wrist-portable equipment.
Figure 4A:
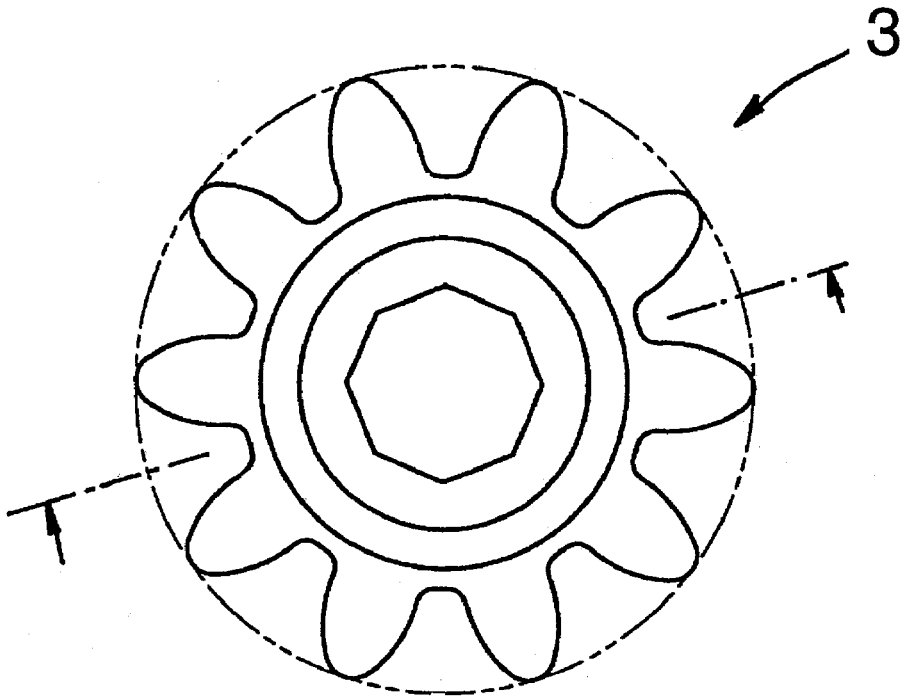
Figure 4B:
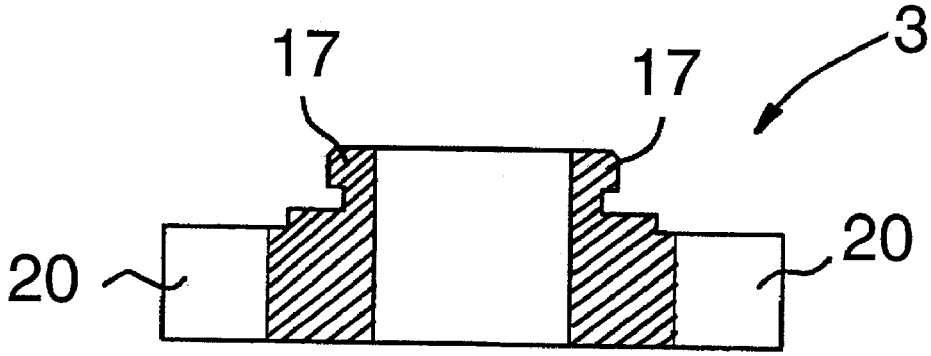
Figure 5A:
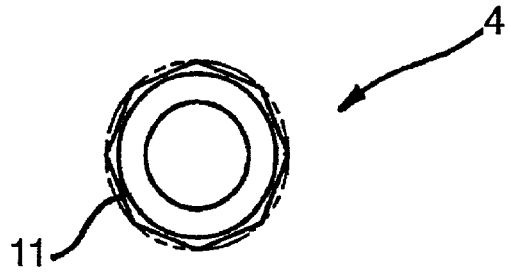
FIGS. 5A–5B are a frontal view and a side elevation view, respectively showing an operating shaft.
Figure 5B:
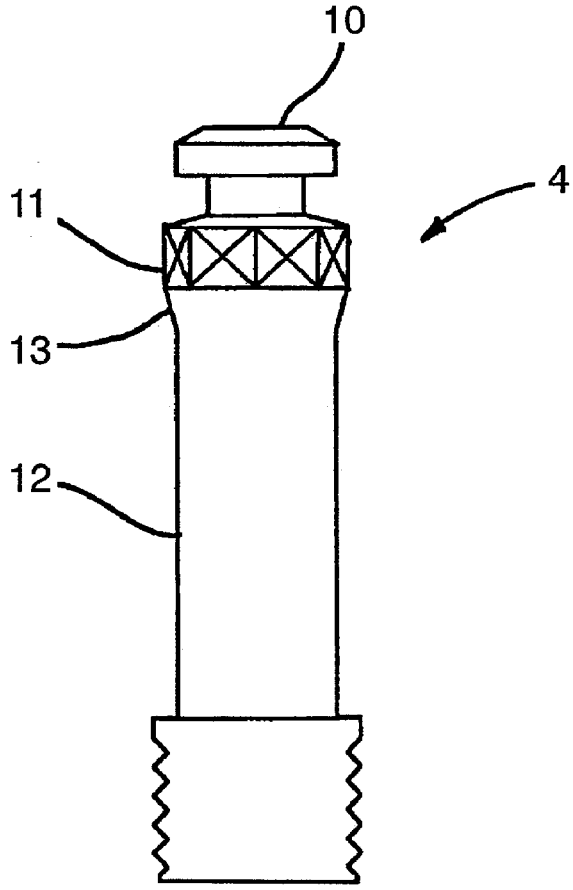

FIGS. 1 and 2 are side elevational cross-sectional views showing the primary part and its vicinity of a wrist-wearable apparatus in the form of a wristwatch 1 in accordance with an embodiment of this invention. FIG. 1 shows a state where a scale ring 103, as an internal rotational ring, is locked and FIG. 2 shows a state where the above-described lock is released. FIG. 3 is an enlarged perspective view showing a clutch 2 of the wristwatch 1 described in FIGS. 1 and 2. FIGS. 4 4A–4B are a plan view and a side elevational cross-sectional view, respectively showing an intermediate wheel 3 described in FIG. 3. FIGS. 5A–5B are a frontal view and a side elevational view respectively, showing an operation or operating shaft 4 described in FIG. 3. Note that, in FIGS. 1 to 5, the same reference numerals are used to indicate the same elements as those of the above-described conventional wristwatch 100 and further explanation therefor will be omitted.

In FIG. 1, a stem 5 made of metal material and provided to the wrist watch 1 has a cup-shaped outer shell 6 and a cylindrical shaft 8 formed integrally with a bottom portion 7 of the above-described outer shell. A cylindrical operating shaft 4 made of metal material and having a diameter that is substantially half that of this shaft 8 is screwed and mounted coaxially with a rotary shaft of the stem 5 at a tip end of the shaft 8 of the above-described stem 5. This operating shaft 4 has a bulged portion 11 having a regular octagonal cross-section in the vicinity of its tip end portion 10 (see FIG. 5). A step between this bulged portion 11 and a cylindrical side surface portion 12 is smoothened by a gently tapered slant surface 13. The above-described operating shaft 4 and the shaft 8 of the stem 5 are inserted into a tubular member comprised of a metal pipe 14 fixed and disposed through a watch case 101. This pipe 14 and the shaft 8 of the above-described stem 5 are kept in a gap fitting relation.

Accordingly, the shaft 8 of the stem 5 may be rotated freely to the pipe 14 for enabling the push-in operation or the draw operation. A tip end portion 10 of the operating shaft 4 inserted into the pipe 14 is located in the interior of the watch case 101 through this pipe 14. An annular intermediate wheel 3 made of metal material is fitted around the tip end portion 10 of the operating shaft 4. Note that, in order to prevent the situation in which the operation shaft 4 is pulled apart from the intermediate wheel 3 by the draw operation of the stem 5, the stop ring 15 is fitted around at the tip end portion 10 of the operating shaft 4. The inner circumferential surface of the intermediate wheel 3 has a regular octagonal shape that may engage with the bulge portion 11 of the above-described operating shaft 4 in a gap fitting manner (see FIG. 3). Accordingly, the intermediate wheel 3 is engaged with the bulged portion 11 of the above-described operating shaft 4 but not engaged with the cylindrical its surface portion 12. The intermediate wheel 3 and the bulged portion 11 of the operating shaft 4 form a clutch assembly for transmitting rotation of the operating shaft 4 to the scale ring 103. Also, the intermediate wheel 3 has a hook-shaped engagement portion 16 on its, top surface and, at this engagement portion 16, is engaged with an engagement piece 17 formed at an end portion of the above-described pipe 14 and held rotatably.

On the other hand, the scale ring 103 provided within the watch case 101 has a rack 116 on its back surface circumferential portion 115. This rack 116 is engaged with teeth 18 of the above-described intermediate wheel 3. Thus the intermediate wheel 3 and teeth 18 constitute a gear wheel. Note that, an annular member 118 provided on a bottom surface portion 115 of the scale ring 103 is a cushion 118 made of a rubber-like material for preventing any displacement of the scale ring 103 upon the rotation. Also, an annular member 119 provided on an outer circumferential surface of the operating shaft 4 is an annular waterproof packing 119 made of rubber-like material for sealing a gap between the operating shaft 4 and the pipe 4.

Also, in this wristwatch 1, the stem 5 has a screw groove 19 on the inner wall surface of its cup-shaped outer shell 6. The pipe 14 has screw crests 20 at an end portion projecting from the watch case 101. This screw groove 19 is fitted with the screw crests 20 of the pipe 14 so that the stem 5 may be fixed to the watch case 101. Also, these screw grooves 19 and screw crests 20 are cut into such a width that the stem 5 may be fixed or released before the bulged portion 11 of the operating shaft 4 and the intermediate wheel 3 are fitted with each other. FIG. 1 is a side elevational cross-sectional view showing the fixed state and FIG. 2 is a side elevational cross-sectional view showing the released state. On the other hand, a coil spring 21 is assembled into the interior of the pipe 14 while being kept in the elastically compressed condition. This coil spring 21 biases its one end portion to the engagement piece 17 at the tip end of the pipe 14 and the other end portion to a tip end portion of the shaft 8 of the stem 5, and works in a direction in which the stem 5 is drawn out from the watch case 101.

In FIG. 1, the stem 5 is kept under the fixed condition by the screw structure 19, 20 to the pipe 14. Under this condition, the operating shaft 4 passes through the intermediate wheel 3 before its bulged portion 11 (i.e., the operating shaft 4 is in a pushed-in position). Accordingly, in the same drawing, since the stem 5 and the scale ring 103 are separated from each other, even if the stem 5 is rotated, the scale ring 103 is not rotated. Also, since the stem 5 per se is firmly fixed by means of the screw, even if the watch is brought into contact with the body or the like when the watch is worn, the stem 5 is not easily rotated.

When the scale ring 103 is to be adjusted, the outer sheet 6 of the stem 5 is pinched by the fingers and is rotated in a direction in which the screws 19, 20 are removed. Then, the screws 19, 20 are disengaged before the bulged portion 11 of the operating shaft 4 is fitted with the intermediate wheel 3. subsequently, the stem 5 is drawn to from the watch case 101 while seeking by the fingertips so that the bulged portion 11 of the operating shaft 4 is fitted with the intermediate wheel 3 (i.e., the operating shaft is in a drawn-out position). Note that, at this time, the coil spring 21 works in a direction in which the stem 5 is drawn from the watch case 101. Accordingly, the stem 5 is only sought while being lightly rotated to fit the bulged portion 11 of the operating shaft 4 in the intermediate wheel 3. When the bulged portion 11 of the operating shaft 4 in the intermediate wheel 3. When the bulged portion 11 is fitted in the intermediate wheel 3, the stem 5 is rotated in the axial direction. Then, the operating shaft 4 is also rotated, and the intermediate wheel 3 is rotated together with this. Then, the rack 116 of the scale ring 103 is fed by means of the teeth 18 of the intermediate wheel 3 and the scale ring 103 is rotated (see FIG. 2). Thus, it is possible to adjust the scale ring 103 to a desired position while watching the scale ring 103 through the glass 112 of the watch by the stem 5.

Furthermore, when the scale ring 103 is to be locked, the stem 5 is pushed into the watch case 101 straightly without any rotation from this condition. Then, the bulged portion 11 of the operating shaft 4 is removed from the intermediate wheel 3 without any feed of the rack 116 of the scale ring. The screw groove 19 of the stem 5 is screwed and fitted with the screw crests 20 of the pipe 14 while being pushed into the watch case 101 and fixed.

According to this wristwatch 1, in the mounted condition of the watch, the stem 5 may be fixed to the watch case 101 by the screw structure 19, 20. Under this condition, even if the watch is brought into contact with the body or the like, there is no fear that the stem 5 would be drawn out of the watch case 101. Also, under the condition that the stem 5 is also fixed to the watch case 101, the operating shaft 4 and the intermediate wheel 3 are separated from each other (see FIG. 1). Accordingly, under this condition, there is no fear of displacement of the scale ring 103. Thus, according to this wristwatch 1, it is possible to effectively prevent the malfunction of the scale ring 103. Note that, in the wristwatch 1 according to this mode of embodiment, the shaft 8 of the stem 5 is a discrete part from the operating shaft 4 but these may be formed integrally with each other as in the modification example to be described later (see FIG. 6).

Also, the inner circumferential surface shape of the intermediate wheel 3 and the bulged portion 11 of the above-described operating shaft 4 are not limited to the regular octagonal shape as described above. Also, the shape of the bulged portion 11 of the above-described operating shaft 4 is not limited to the angular post shape but may be an angular conical shape, a truncated angular conical shape, a conical shape, a truncated conical shape or any other tapered shape. Also, the materials of the bulged portion 11 of the above-described operating shaft 4 and the intermediate wheel 3 are not limited to the metal material but may be rubber-like material or any other frictional material.

Also, in the mode of this embodiment, the structure of direct engagement of the intermediate wheel 3 and the rack 116 of the scale ring 103 is taken but it is possible to arrange one or more discrete gears (not shown) in the midway of these and to splice the intermediate gear 3 and the rack 116 of the scale ring 103 with each other. Also, in the mode of this embodiment, the rack 116 of the scale ring 103 is formed on the back surface circumferential edge portion of the scale ring 103. However, the structure is not limited thereto but the rack 116 may be formed on a side surface portion or a top surface portion.

Furthermore, in the mode of this embodiment, the cushion 118 of the above-described internal rotational ring is installed between the bottom surface portion of the scale ring 103 and the clockface 102 but the invention is not limited thereto. It is possible to install the cushion 118 between the side surface portion 114 of the scale ring 103 and the inner wall of the watch case 101 (see FIG. 6).

Also, the fastening structure of the stem 5 is not limited to the above-described screw structure 19, 20 but may be a structure with a bayonet structure (not shown). Also, a discrete stop screw (not shown) is provided to the stem 5 separately from the above-described screw structure 19, 20 so that the stem 5 may be fixed by means of this stop screw. The reason for this is that, if it may prevent the draw operation of the stem 5 due to the unintended operation, the malfunction of the scale ring 103 may be prevented. Also, the structure is not limited to the case where the coil spring 21 is provided within the pipe 14 but the coil spring 21 may be installed within the outer shell 7 of the stem 5 (see FIGS. 6 and 7).

Figure 6:
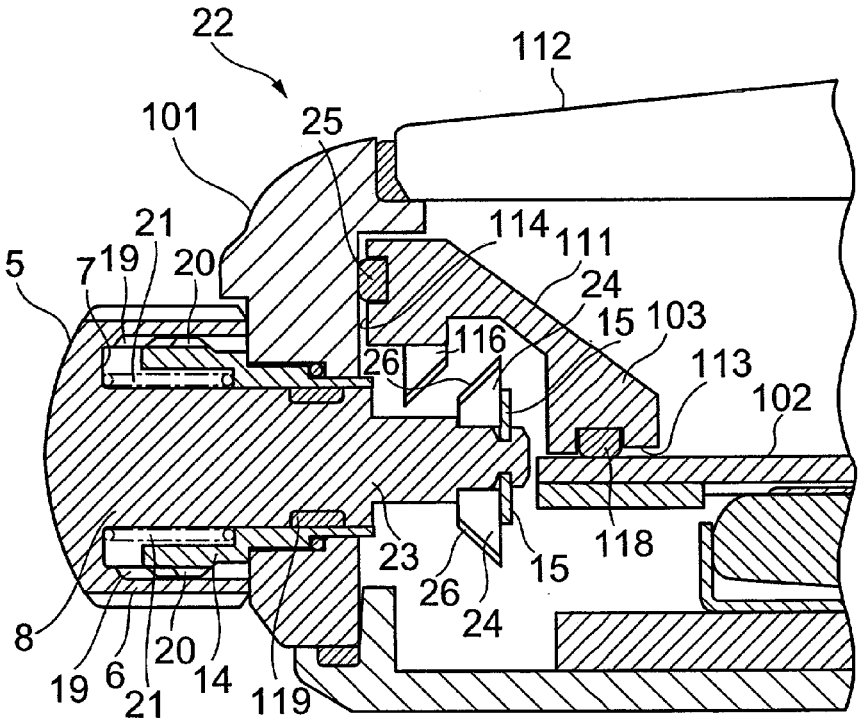
FIG. 6 is across-sectional view showing a modification example of the wrist-portable equipment shown in FIG. 1.
Figure 7:
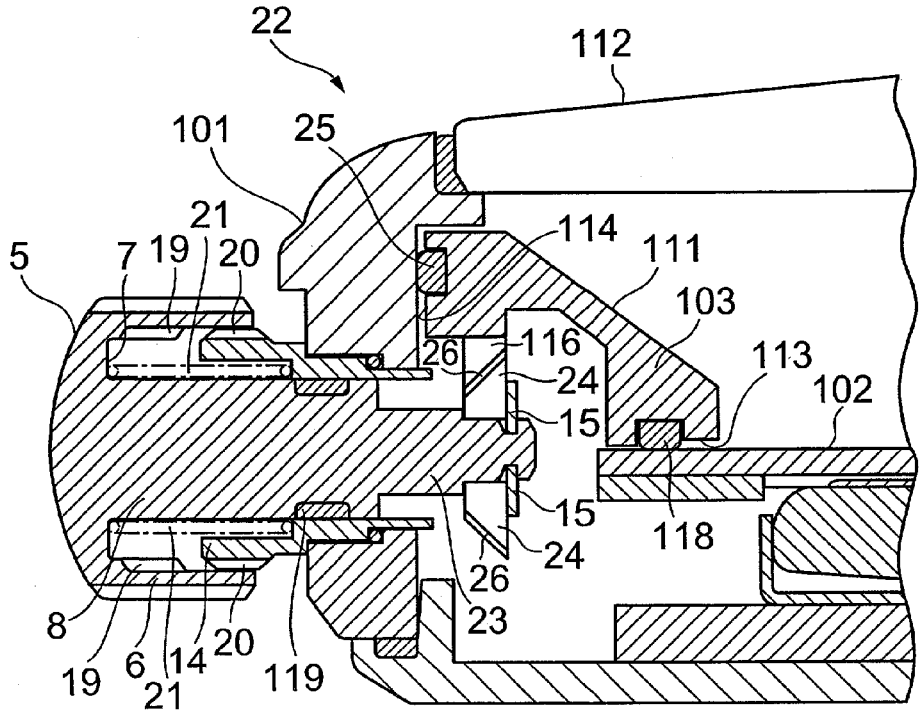
FIG. 7 is a cross-sectional view showing the modification example of the wrist-portable equipment shown in FIG. 1.
Figure 8:
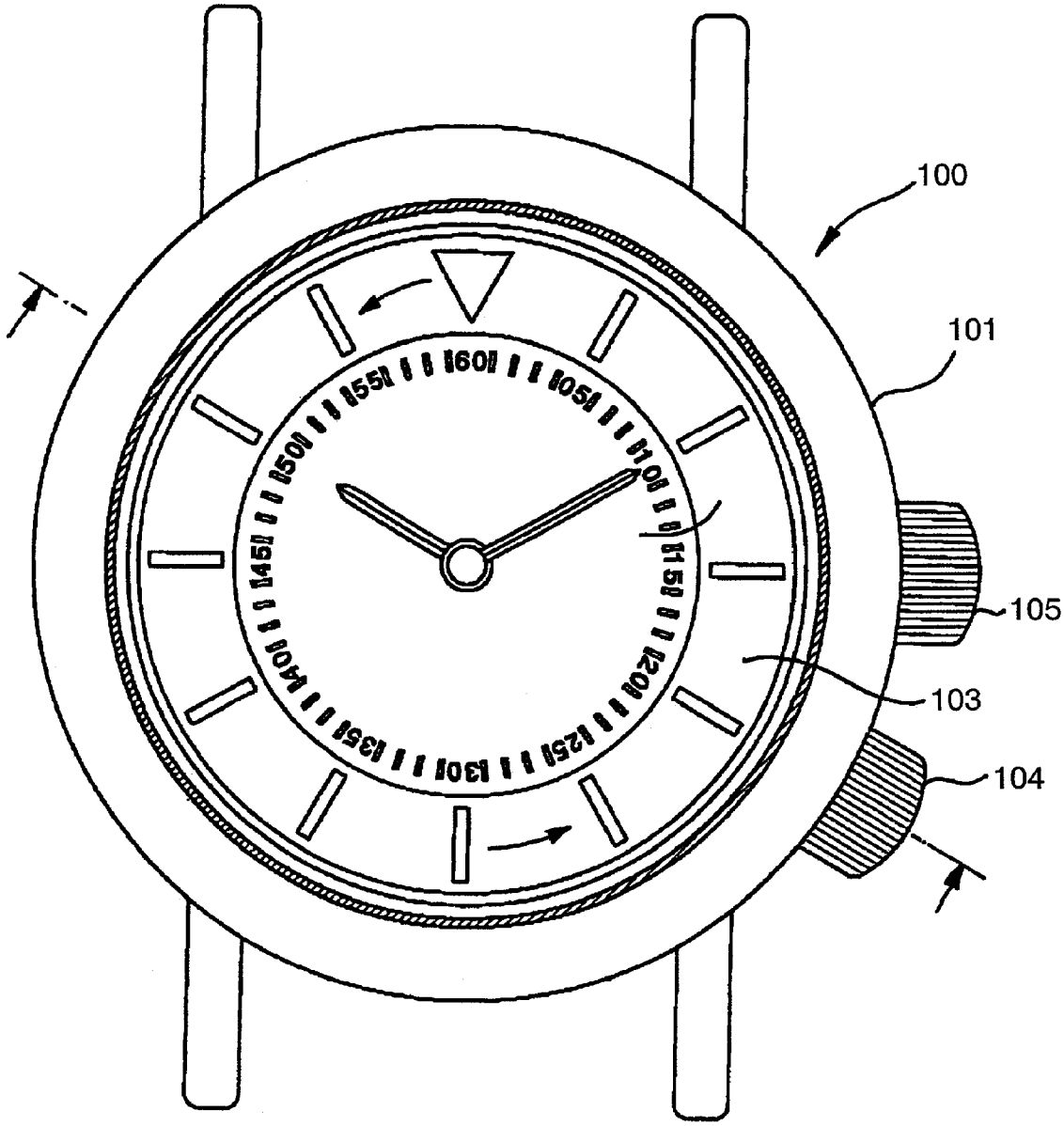
PRIOR ART FIG. 8
FIG. 8 is a plan view showing a conventional wrist-portable equipment.
Figure 9:
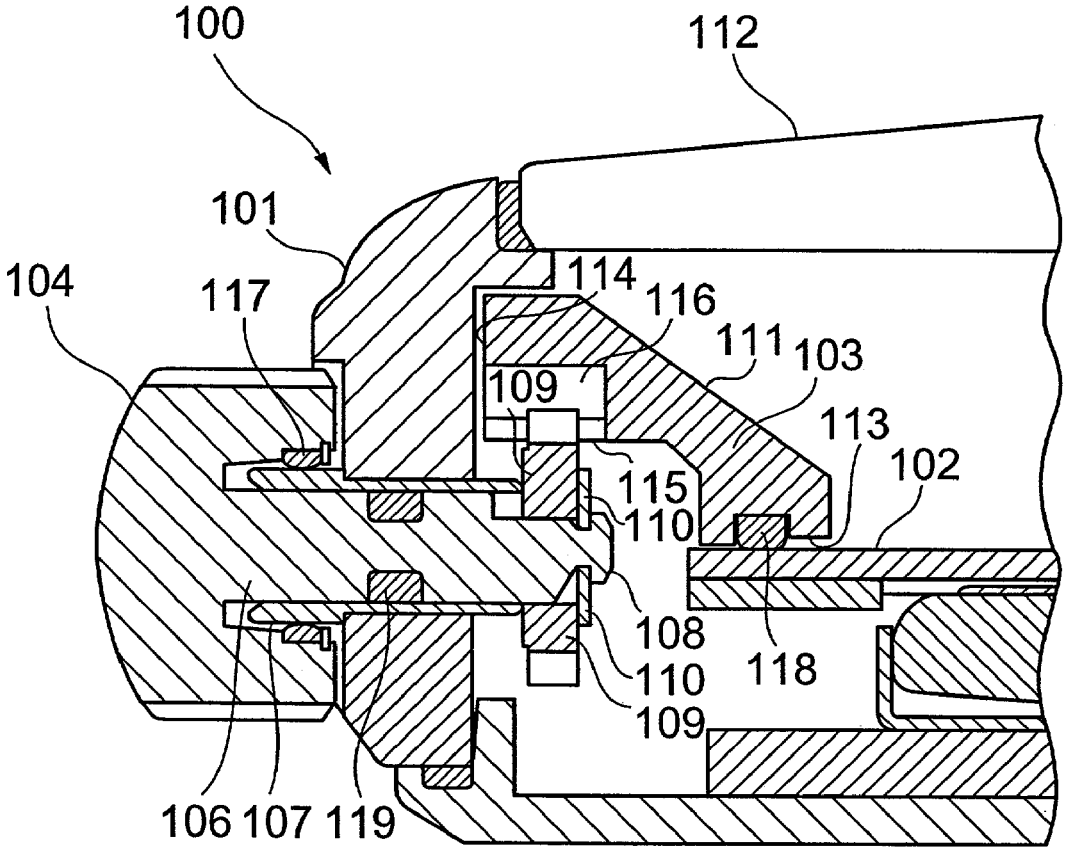
PRIOR ART FIG.9
FIG. 9 is a side elevational cross-sectional view showing a primary part of the conventional wrist-portable equipment shown in FIG. 8.

FIGS. 6 and 7 are side elevation cross-sectional view showing a modification example of a wristwatch 1 in accordance with the mode of the embodiment described in FIGS. 1 to 5. FIG. 6 shows the locked state of the scale ring 103 and FIG. 7 shows the released state thereof, respectively. Note that, in FIGS. 6 and 7, the same reference numerals are used to indicate the same elements as those in the above-described prior art and the mode of embodiment and the explanation therefor will be omitted.

In FIGS. 6 and 7, the wristwatch 22 has the stem 5 on the side surface of the watch case 101 and has the scale ring 103 in the interior of the watch case 101. This stem 5 is made of metal material and has a cup-shaped outer shell 7. Also, a cylindrical shaft 8 is formed integrally with an inner bottom surface portion of the outer shell 7. Furthermore, a cylindrical operating shaft 23 having a diameter that is substantially half of that of this shaft 8 is formed integrally with the tip end portion of this shaft 8. Also, the wristwatch 22 has a pipe 14 fixed and provided passing through the watch case 101 from the side surface direction. The shaft 8 of the stem and the operating shaft 23 are inserted into the pipe 14. The tip end of the operating shaft 23 is introduced into the interior of the watch case 101, passing through the pipe 14.

The shaft 8 of the stem 5 and the pipe 14 are kept under the gap fitting condition with each other. The stem 5 may perform the rotational operation, the draw operation and the push-in operation to the pipe 14 as desired. Also, a bevel gear 24 made of metal material is fitted in the tip end portion of the operating shaft 23, with its engagement portion 26 in the draw direction of the operating shaft 23 and fixed by means of a stop ring 15 made of metal material. On the other hand, a rack 116 engaging with the above-described bevel gear 24 is formed in the back surface circumferential edge portion of the scale ring 103. Note that, an annular waterproof packing 119 made of rubber-like material is provided on the outer circumferential surface of the shaft 8 of the stem 5. Also, an annular cushion 25 made of rubber-like material for preventing any displacement upon the rotation is provided on a side surface portion 114 and a bottom surface portion 113 of the scale ring 103.

In the wristwatch 22 described in FIG. 6, since the stem 5 is fixed to the watch case 101 by means of the screw structure 19, 20 and the bevel gear 24 and the rack 116 are kept under the separated condition from each other, the scale ring 103 is not rotated under this condition. Here, when the scale ring 103 is to be adjusted, the stem 5 is pinched and rotated by the fingers to thereby disengage the screw structure 19, 20 and separate from the pipe 14. Then, the stem 5 is drawn out of the watch case 101 so that the operating shaft 23 is shifted in the draw direction. Then, the bevel gear 24 fixed to the tip end of the operating shaft 23 is also shifted to engage with the rack 116 of the scale ring 103 (see FIG. 7). Under this condition, when the stem 5 is rotated, the bevel gear 24 is also rotated, the rack 116 is fed, and the scale ring 103 is also rotated. Thus, it is possible to adjust the scale ring 103 to a desired position while watching the scale ring 103 through the glass 112 of the watch.

According this wristwatch 1, under the mounted condition of the watch, the stem 5 is fixed to the watch case 101 by the screw structure 19, 20 and the operating shaft 23 and the intermediate wheel 3 are separated from each other (see FIG. 1). Accordingly, even if the watch is brought into contact with the body or the like, the stem 5 would not be readily rotated. Also, even if the stem is erroneously rotated, there is no displacement in position of the scale ring 103. Thus, according to this wristwatch 22, it is possible to effectively prevent the malfunction of the scale ring 103. Also, the rotational transmission means to the scale ring 103 is formed by a bevel gear 24, the engagement surface of the gear is directed in the draw direction of the stem 5. Accordingly, the separation operation from, and the engagement operation with the rack 116 may be performed more easily than those of the post-shaped gear (not shown).

Note that, in the wristwatch 22 that is the present modification example, the bevel gear 24 and the rack 116 are used as the engagement means with the scale ring 103 but these may be frictional members having conical shapes or truncated conical shapes.

As described above, according to the wrist-portable equipment that is this invention, since under the mounted condition of the instrument, the stem and the internal rotational ring may be separated from each other at the clutch, it is possible to effectively prevent the malfunction of the internal rotational ring caused by the contact between the stem and the body or the like.

Also, according to the wrist-portable equipment that is this invention, since the bulged portion of the operating shaft has a polygonal cross-section and is engaged on at least one surface with the inner circumferential surface of the intermediate wheel, the bulged portion is engaged firmly with the inner circumferential surface of the intermediate wheel also in the case where the operating shaft is made of non-frictional material such as metal material or the like.

Also, according to the wrist-portable equipment that is this invention, since the bulged portion of the operating shaft is formed of frictional material, it is unnecessary to seek the engagement surface of the clutch by rotating the stem for bringing this bulged portion into contact with the inner circumferential surface of the intermediate wheel. Thus, it is possible to release the lock of the stem with ease.

Also, according to the wrist-portable equipment that is this invention, since the stem may be fixed to the case, it is possible to prevent the situation where the stem is erroneously drawn out under the condition that the internal rotational ring is locked. Thus, it is possible to completely prevent the malfunction of the internal rotational ring.

Also, according to the wrist-portable equipment that is this invention, since the cushion member is installed also on the side surface of the internal rotational ring, it is possible to prevent the displacement upon the rotation of the internal rotational ring more effectively than in the case of the conventional wrist-portable equipment.

What is claimed is:

1. A wrist-portable apparatus comprising:

a case;

a display member rotatably mounted in the case for displaying information;

an operational shaft mounted to undergo rotational and sliding movements relative to the case so that the operational shaft may be axially displaced between a pushed-in position, in which the operational shaft is pushed into the case, and a drawn-out position, in which the operational shaft is drawn out from the case;

a clutch assembly for transmitting rotational movement of the operational shaft to the display member to rotate the display member when the operational shaft is displaced to the drawn-out position and for releasing the transmission of the rotational movement of the operational shaft to the display member when the operational shaft is displaced to the pushed-in position, the clutch assembly comprising a gear wheel engaged with the display member and connectable to the operational shaft to transmit rotational movement of the operational shaft to the display member when the operational shaft is displaced to the drawn-out position;

a manual control stem integrally connected to an end of the operational shaft and disposed on a side surface portion of the case for controlling rotation of the operational shaft and displacement of the operational shaft to the pushed-in and drawn-out positions; and a tubular member integrally connected to the case and having a first end portion disposed in the case and engaging a portion of the gear wheel so as to allow rotational movement of the gear wheel relative to the tubular member, and having a second end portion extending outwardly from the case for removable locking engagement with the manual control stem to integrally connect the manual control stem to the case when the operational shaft is displaced to the pushed-in position.

2. A wrist-portable apparatus according to claim 1; wherein the gear wheel has a through-hole through which the operational shaft passes when the operational shaft is displaced to the pushed-in position; and wherein the clutch assembly further comprises a bulged portion formed at an end portion of the operational shaft and received by the through-hole of the gear wheel for locking engagement with the gear wheel when the operational shaft is displaced to the drawn-out position so that rotational movement of the operational shaft rotates the gear wheel to rotate the display member.

3. A wrist-portable apparatus according to claim 2; wherein the bulged portion of the operational shaft is generally polygonal-shaped in cross-section.

4. A wrist-portable apparatus according to claim 2; wherein the bulged portion of the operational shaft is made of a friction material.

5. A wrist-portable apparatus according to claim 2; wherein the second end portion of the tubular member has an outer threaded section; and wherein the manual control stem has an inner threaded section for threaded engagement with the outer threaded section of the tubular member to integrally connect the manual control stem to the case when the operational shaft is displaced to the pushed-in position.

6. A wrist-portable apparatus according to claim 5; wherein the threaded engagement between the inner and outer threaded sections of the manual control stem and the tubular member, respectively, is released by rotational movement of the manual control stem in a direction of rotation resulting in displacement of the operational shaft to the drawn-out position.

7. A wrist-portable apparatus according to claim 6; wherein the threaded engagement between the inner and outer threaded sections of the manual control stem and the tubular member, respectively, is released before the bulged portion of the operational shaft is received by the through-hole of the gear wheel during displacement of the operational shaft to the drawn-out position.

8. A wrist-portable apparatus according to claim 1; further comprising a cushioning member made of an elastic material and disposed between a side surface of the display member and an inner wall of the case.

9. A wrist-portable apparatus according to claim 1; wherein the display member is generally ring-shaped.

10. A wrist-portable apparatus according to claim 1; wherein the locking engagement between the manual control stem and the second end portion of the tubular member is released by rotational movement of the manual control stem in a direction of rotation resulting in displacement of the operational shaft to the drawn-out position.

11. A wrist-portable apparatus according to claim 10; wherein the gear wheel has a through-hole through which the operational shaft passes when the operational shaft is displaced to the pushed-in position; and wherein the clutch assembly further comprises a bulged portion formed at an end portion of the operational shaft and received by the through-hole of the gear wheel for locking engagement with the gear wheel when the operational shaft is displaced to the drawn-out position so that rotational movement of the operational shaft rotates the gear wheel to rotate the display member.

12. A wrist-portable apparatus according to claim 11; wherein the locking engagement between the manual control stem and the second end portion of the tubular member is released before the bulged portion of the operational shaft is received by the through-hole of the gear wheel during displacement of the operational shaft to the drawn-out position.

* * * * *